US009644166B2

(12) United States Patent
Mosleh

(10) Patent No.: US 9,644,166 B2
(45) Date of Patent: May 9, 2017

(54) SURFACE CONDITIONING NANOLUBRICANT

(75) Inventor: Mohsen Mosleh, Bethesda, MD (US)

(73) Assignee: Howard University, Washington, DC (US)

( * ) Notice: Subject to any disclaimer, the term of this patent is extended or adjusted under 35 U.S.C. 154(b) by 505 days.

(21) Appl. No.: 14/356,700

(22) PCT Filed: May 25, 2012

(86) PCT No.: PCT/US2012/039593

§ 371 (c)(1),
(2), (4) Date: Aug. 27, 2014

(87) PCT Pub. No.: WO2012/166604

PCT Pub. Date: Dec. 6, 2012

(65) Prior Publication Data

US 2014/0371118 A1 Dec. 18, 2014

Related U.S. Application Data

(60) Provisional application No. 61/490,986, filed on May 27, 2011.

(51) Int. Cl.
*C10M 125/22* (2006.01)
*C10M 171/06* (2006.01)

(52) U.S. Cl.
CPC ..... *C10M 125/22* (2013.01); *C10M 171/06* (2013.01); *C10M 2201/041* (2013.01);
(Continued)

(58) Field of Classification Search
CPC ..... C10M 125/22; C10M 171/06; C10M 2201/041; C10M 2201/061;
(Continued)

(56) References Cited

U.S. PATENT DOCUMENTS 6,245,725 B1 * 6/2001 Tanaka ..... C10M 141/08 508/363
8,038,751 B2 10/2011 Starling
(Continued)

FOREIGN PATENT DOCUMENTS

JP 2004-076003 A 3/2004
JP 2006-045350 A 2/2006
(Continued)

OTHER PUBLICATIONS

PCT International Search Report and Written Opinion of the International Searching Authority dated Sep. 4, 2012 for International Application No. PCT/US2012/039593, 13 pages.
(Continued)

*Primary Examiner* — James Goloboy
(74) *Attorney, Agent, or Firm* — Fitch, Even, Tabin & Flannery, LLP

(57) ABSTRACT

A nanolubricant composition is described where the lubricant composition includes a flowable oil or grease with nanoparticles dispersed in the flowable oil or grease. The nanoparticles are configured to polish a surface of a structure slowly over a period of time. The nanoparticles a hardness of at least about 7 Mohs and a diameter that is less than one half the arithmetic average roughness of the surface or a length that is less than one half of the arithmetic average roughness of the surface.

17 Claims, 3 Drawing Sheets

(52) U.S. Cl.
CPC . *C10M 2201/061* (2013.01); *C10M 2201/062* (2013.01); *C10M 2201/065* (2013.01); *C10M 2201/066* (2013.01); *C10M 2201/105* (2013.01); *C10N 2210/03* (2013.01); *C10N 2210/04* (2013.01); *C10N 2210/06* (2013.01); *C10N 2220/022* (2013.01); *C10N 2220/082* (2013.01); *C10N 2220/084* (2013.01); *C10N 2230/02* (2013.01); *C10N 2230/06* (2013.01); *C10N 2240/10* (2013.01); *C10N 2250/04* (2013.01); *C10N 2250/10* (2013.01); *C10N 2250/12* (2013.01); *C10N 2250/121* (2013.01)

(58) Field of Classification Search
CPC ..... C10M 2201/062; C10M 2201/065; C10M 2201/066; C10M 2201/105; C10N 2210/04; C10N 2210/06; C10N 2220/022; C10N 2220/082; C10N 2220/084; C10N 2230/02; C10N 2230/06; C10N 2240/10; C10N 2250/04; C10N 2250/10; C10N 2250/12
USPC ..... 508/129, 165, 167
See application file for complete search history.

(56) References Cited

U.S. PATENT DOCUMENTS

| | | | | |
|---|---|---|---|---|
| 8,445,415 | B2 | 5/2013 | Mabuchi et al. | |
| 8,598,098 | B2 | 12/2013 | Nakagawa et al. | |
| 2007/0158609 | A1 | 7/2007 | Hong et al. | |
| 2008/0081541 | A1 | 4/2008 | Kozasa et al. | |
| 2008/0172951 | A1 | 7/2008 | Starling | |
| 2008/0194377 | A1 | 8/2008 | Mordukhovich et al. | |
| 2008/0234149 | A1* | 9/2008 | Malshe | C10M 141/10 508/150 |
| 2008/0242566 | A1* | 10/2008 | Lockwood | B82Y 30/00 508/113 |
| 2008/0248979 | A1* | 10/2008 | Nakagawa | B82Y 30/00 508/128 |
| 2008/0269086 | A1* | 10/2008 | Adhvaryu | C10M 103/00 508/155 |
| 2008/0312111 | A1 | 12/2008 | Malshe et al. | |
| 2009/0042751 | A1 | 2/2009 | Narayan | |
| 2009/0152050 | A1 | 6/2009 | Hattori et al. | |
| 2010/0004147 | A1 | 1/2010 | Mizrahi | |
| 2010/0029182 | A1 | 2/2010 | Fukuda et al. | |
| 2010/0050872 | A1 | 3/2010 | Lee | |
| 2010/0187925 | A1 | 7/2010 | Tingler et al. | |
| 2011/0003721 | A1 | 1/2011 | Hong et al. | |

FOREIGN PATENT DOCUMENTS

| | | | |
|---|---|---|---|
| JP | 2006-241277 | A | 9/2006 |
| JP | 2008-179738 | A | 8/2008 |
| JP | 2009-523863 | A | 6/2009 |
| JP | 2010-053236 | A | 3/2010 |
| JP | 2010-516487 | A | 5/2010 |
| JP | 2013-538274 | A | 10/2013 |
| WO | 2007/082299 | A2 | 7/2007 |
| WO | 2010/083041 | A1 | 7/2010 |
| WO | 2012/029191 | A1 | 3/2012 |

OTHER PUBLICATIONS

PCT International Preliminary Report on Patentability of the International Searching Authority dated Apr. 3, 2014 for International Application No. PCT/US2012/039593, 7 pages.
PCT International Search Report and Written Opinion of the International Searching Authority dated Aug. 31, 2012 for International Application No. PCT/US2012/039621, 11 pages.
PCT International Preliminary Report on Patentability of the International Searching Authority dated Dec. 12, 2013 for International Application No. PCT/US2012/039621, 6 pages.
European Patent Office Extended European Search Report dated Oct. 22, 2014 for European Patent Application No. EP 12 79 3537.7, 7 pages.
European Patent Office Extended European Search Report dated May 7, 2015 for European Patent Application No. EP 12 793 362.0, 9 pages.
J. L. Viesca et al., Antiwear properties of carbon-coated copper nanoparticles used as an additive to a polyalphaolefin, Tribology International, Feb. 7, 2011, vol. 44, No. 7, pp. 829-833.
U.S. Appl. No. 14/356,703, entitled "Hybrid Nanolubricant," which entered the U.S. national phase from International Application No. PCT/US2012/039621, filed May 25, 2012.

* cited by examiner

SURFACE CONDITIONING NANOLUBRICANT

CROSS-REFERENCE TO RELATED APPLICATION

This application is a U.S. national phase application filed under 35 U.S.C. §371 of International Application PCT/US2012/039593, filed 25 May 2012, designating the United States, which claims benefit of U.S. Provisional Patent Application No. 61/490,986, filed May 27, 2011, which are hereby incorporated herein by reference in their entirety.

FIELD OF THE INVENTION

The present application generally relates to nanolubricants, and more specifically to nanolubricants containing surface conditioning nanoparticles which condition and/or polish a surface or multiple interacting surfaces.

BACKGROUND OF THE INVENTION

Generally, lubricating oils are designed to reduce friction between moving automotive components and protect their surfaces by covering them with a film of lubricant. Generally, lubricating oils are also designed to prevent or reduce wear of moving surfaces by creating a chemical film that facilitates shearing at the interface, instead of shearing through the asperities of the contacting surfaces. The oil may also serve other functions such as preventing corrosion by neutralizing acids that are formed at hot spots, improving sealing at some interfaces, cleaning the rubbing surface and transporting the waste products out of the contract zone, and carrying heat away from hot surfaces. These vast requirements necessitate different compositions and physical properties for the lubricant for performing various required lubrication functions.

The concept of nanofluids, i.e., nanoparticle-fluid dispersions, was introduced in the mid 1950's at the Argonne National Laboratory. Compared with millimeter- or micrometer-sized particle suspensions, nanofluids generally possess improved long term stability, much higher surface area, as well as improved mechanical, thermal and rheological properties. However, recent research efforts on nanofluids have mainly been focused on the preparation and evaluation of water or ethylene glycol (EG)-based nanofluids while reports of the synthesis of oil-based nanofluids are relatively uncommon.

There have been several mechanisms contemplated in the literature by which dispersed nanoparticles in lubricants result in lower friction and wear. These mechanisms include: formation of a transferred solid lubricant film from nanoparticles under the contact pressure, rolling of spherical nanoparticles in the contact zone, reducing asperity contact by filling the valleys of contacting surfaces, and shearing of nanoparticles at the interface without the formation of an adhered film.

A new mechanism for the role of solid lubricant nanoparticles was recently proposed. According to the proposed mechanism, one role of solid lubricant nanoparticles in oils and greases is to break apart the wear agglomerate that is commonly formed at the sliding interface. The wear agglomerate, sometimes referred to as the transferred film, is normally adhered to the harder surface. The entrapment of the wear agglomerate reduces the contact area which in turn causes the normal contact pressure to be increased. Therefore, the plowing of the mating surface by the wear agglomerate is enhanced. The enhanced plowing increases friction and wear. The wear debris agglomeration process and some factors that affect it are discussed in the literature.

However, in addition to preventing wear and lubricating the surfaces, it is also often desirable to improve performance of the lubricated surfaces. In this regard, it may be desirable to minimize the overall lubricant film thickness to improve fuel economy and other performance factors. However, depending on the film thickness and the roughness of the surfaces, the surfaces may experience undesired wear.

SUMMARY OF THE INVENTION

A nanolubricant composition is described where the lubricant composition includes a flowable oil or grease with nanoparticles dispersed in the flowable oil or grease. The nanoparticles are configured to polish a surface of a structure slowly over a period of time. The nanoparticles have a hardness of at least about 7 Mohs (equivalent to 820 kg/mm$^2$ in Knoop scale) and a diameter that is less than one half the arithmetic average roughness of the surface or a length that is less than one half of the arithmetic average roughness of the surface. In one form, the nanoparticles are selected from the group consisting of diamond, aluminum oxide, silicon oxide, boron carbide, silicon carbide and zirconium oxide.

Further, in another form, the nanoparticles include multi-component nanoparticles. The multi-component nanoparticles include a first nanoparticle component which effects shearing at the surface and a second nanoparticle which effects polishing of the surface. In this regard, the first nanoparticle component has a generally low shear strength and may include molybdenum disulfide, tungsten disulfide, boron nitride and graphite. The second nanoparticle component may have a hardness of at least about 7 Mohs.

In an important aspect, the first nanoparticle component is a core of the integrated multi-component particle and the second nanoparticle component at least partially coats the first nanoparticle component or completely coats the first nanoparticle component. In another aspect, the second nanoparticle component is at least partially embedded or fully embedded into the first nanoparticle component.

Further, according to one form, the nanoparticles have an average diameter of less than about 35 nm. The nanoparticles may also, or, in the alternative, have an average length of less than about 35 nm.

In one form, the nanoparticles and/or the multi-component nanoparticles include diamond, aluminum oxide, silicon oxide, boron carbide, silicon carbide and zirconium oxide. Further, according to one form, the nanolubricant comprises from about 0.1 to about 5 weight percent nanoparticles in the composition consisting essentially the nanoparticles having a hardness of at least 7 Mohs.

Also described herein is a method of in-situ nanopolishing a contact surface. The surface is polished using the nanolubricant containing nanoparticles and/or multi-component nanoparticles.

DETAILED DESCRIPTION

The present application relates to nanolubricants/fluids that extend the range of elastohydrodynamic and hydrodynamic lubrication regimes. For example, the nanolubricants may lower friction and power consumption in mechanical machines. In one form, the approach is to introduce a suitable concentration of surface conditioning nanoparticles (SCN) of selected materials of specified characteristic sizes so that the resultant nanolubricant conditions and polishes the surfaces of moving components at nanoscale. The nanopolishing will result in a lower composite roughness of interacting surfaces which in turn increases the ratio of lubricant film thickness to the composite surface roughness known as lambda without causing high-rate abrasion and wear which are not desirable. The increased lambda results in lower friction and power consumption.

Figure 1:
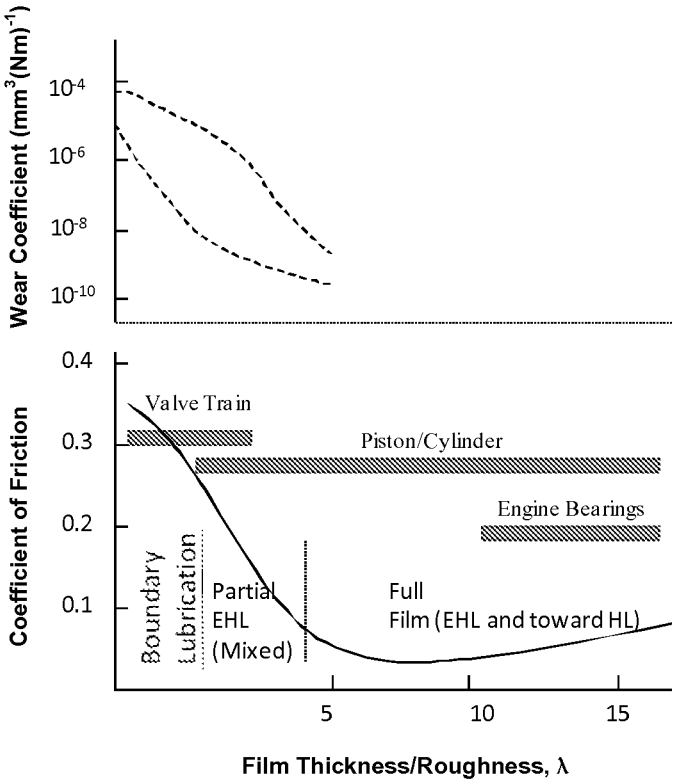
FIG. 1 is a graph representing the film thickness ratio, coefficient of friction and wear coefficient over various lubrication regimes.

The state of lubrication in various moving components is different depending on the nature of contact, relative speed, loading and other conditions. FIG. 1 exhibits different lubricating regimes in major engine components. Lambda is the film thickness ratio and defined as:

$$\lambda = h/\sigma$$

Where h is the film thickness and $\sigma$ is the composite surface roughness defined as:

$$\sigma = (\sigma_1^2 + \sigma_2^2)^{0.5}$$

$\sigma_1$ and $\sigma_2$ are the root mean square (RMS) roughnesses of contacting surfaces. The data shown in FIG. 1 is plotted against data from Hutchings, I.M., "Tribology: Friction and Wear of Engineering Materials", Edward Arnold, Great Britain, p. 273 (1992). When lambda is small, surfaces are contacting each other such that there is a high coefficient of friction.

The lubrications regimes are:

Hydrodynamic (HL) regime in which a film of lubricant completely separates surfaces. The external load is carried by the developed pressure in the film by hydrodynamic action. Dynamic viscosity of the lubricant is the most important characteristic.

Elastohydrodynamic (EHL) regimes in which a thinner (compared with Hydrodynamic regime) separates surfaces but the elastic deformation of the surfaces is an important consideration.

Mixed regime in which some level of asperity contact and some separation due to a thin film occur at the surface and the load capacity is calculated based on both elastohydrodynamic and boundary lubrication considerations.

Boundary Lubrication in which asperity contact is dominant and the role of dynamic viscosity is insignificant. Instead, the additives in oil pay an important role on the overall tribological properties.

Due to the extremely low coefficient of friction (COF) in HL and EHL regimes, the bearing surfaces are desired to operate in these regimes to yield minimum power loss and minimal, if any, wear. However, oftentimes such a desire cannot be fulfilled due to geometrical constraints and operating conditions. The oil, therefore, usually must operate in various lubrication regimes and satisfy all the required functional parameters. An important issue here is that innovative developments in the lubricating oils for enhanced lubrication and reduced friction and wear across all the lubrication regimes can be made more economically than incorporating complicated hardware changes.

One notable trend in engine lubrication is to reduce the film thickness by using lower viscosity engine oils for reducing frictional losses and improving fuel economy. While this approach can help reduce friction in components with hydrodynamic lubrication, it can lead to potential durability problems and a more critical role for the surface topography of engine components.

From FIG. 1, it follows that greater film thickness ratio (lambda) yields lower friction due to enhanced or extended EHL and HL regimes. Lambda can be changed by controlling oil properties and the operating conditions that affect the film thickness. It can also be controlled by changing the surface roughness characteristics of the mating surfaces. Normally, the latter is left to the automotive and engine manufacturers and the lower limit of surface roughness is dictated by their cost or processing constraints.

In one form, a nanolubricant is described that will condition, i.e., polish, the mating surfaces in an extremely-slow polishing process. A surface conditioning component will reduce the composite surface roughness and result in greater film thickness ratio. The critical surface roughness beyond which the surface roughness will not improve in abrasive flow polishing is bounded by the maximum indentation depth of the abrasive grain which for a spherical particle is its diameter. However, these processes cause high-rate abrasion and wear which are not desirable in engine oil applications.

Considering the typical surface roughness values of engine components in the range of 100-200 nm, the use of 35 nm polishing nanoparticles can ideally yield the improvements on the composite surface roughness and film thickness ratio of main bearing components shown in Table 1. It is assumed that maximum depth of penetration of 8 nm can be achieved due to the flow of the lubrication on the surface due to hydrodynamic pressure in HL regime or the contact pressure at the asperity contact level in mixed and boundary lubrication regimes. It is noteworthy that:

In HL and EHL lubrication systems, i.e., engine bearings and portion of piston/ring operations, where a film separates the contacting surfaces, the conditioning by nanoparticles can only be achieved through erosion by suspended hard nanoparticles.

In boundary and mixed lubrication regimes, because of the asperity contact, the mechanism of surface conditioning by nanoparticles is similar to that of common polishing and lapping processes. The difference, however, is a much smaller material removal rate due to smaller diameter size of nanoparticles.

TABLE 1

Effects of surface conditioning on film thickness ratio

| Component | Reduction in Composite Surface Roughness (%) | Increase in Film Thickness Ratio λ (%) |
|---|---|---|
| Piston Ring and Skirt | 8 | 9 |
| Engine Bearing | 5 | 6 |
| Cam/Follower | 6 | 7 |

The proposed approach is to create nanolubricants whose base oil is either an engine oil or a transmission oil. The base oil is modified with nanoparticles of hard materials whose mean particle size is between few to few tens of nanometers. In order to minimize the cost and to prevent high-rate abrasion, the nanoparticle concentration of choice is 0.1-5% by weight. Nanoparticles with high aspect ratio and sharp corners are preferred for the polishing action. However, other geometries such as spherical nanoparticles can also be used. Nanoparticle materials include diamond, boron carbide, silicon carbide, aluminum oxide, zirconium oxide and silicon oxide. The hardness for these exemplary compositions are illustrated in Table 2.

TABLE 2

Hardness of bulk materials for SC nanoparticles

| | Mohs | Knoop (kg/mm$^2$) |
|---|---|---|
| Diamond | 10 | 7000 |
| Boron Carbide ($B_4C$) | 9.3 | 3200 |
| Silicon Carbide (SiC) | 9.2 | 2500 |
| Aluminum Oxide ($Al_2O_3$) | 9 | 2150 |
| Zirconium Oxide ($ZrO_2$) | 8 | 1200 |
| Silicon Oxide ($SiO_2$) | 7 | 820 |

Generally, it is desired to have the diameter of the hard nanoparticles be less than one half of the arithmetic average roughness of the surface it is contacting. If the nanoparticles are not spherical, it is generally desired to have the characteristic length be less than one half of the arithmetic average roughness of the surface it is contacting. For example, in one form, the diameter of the nanoparticles is 35 nm. The above described size allows the nanoparticles to polish the surface slowly over time as opposed to causing excessive wear to the surface.

The nanoparticles may also polish the surface to increase the ratio of the film thickness of the nanolubricant to the composite roughness of the surface. As noted above, as the average roughness decreases, the ratio increases without necessarily changing the properties of the nanolubricant.

In one form, the nanolubricant generally includes a base lubricant, such as grease or oil. A base oil may include a variety of well-known base oils. For example, the lubricant oil may include organic oils, petroleum distillates, synthetic petroleum distillates, vegetable oils, greases, gels, oil-soluble polymers and combinations thereof. The lubricant may have a wide variety of viscosities. For example, if the lubricant is an oil, the viscosity may be in the range of about 10 to 300 centistokes. In another form, the lubricant is a grease having a viscosity of about 200 to 500 centistokes.

The nanolubricant may also include other nanoparticles beyond the hard, surface conditioning nanoparticles described above. For example, the nanolubricant may include a friction or shear modifying component. This component may be a solid lubricant with a lamellar molecular structure that provides easy shearing at the asperity contact level. For example, the friction wear modifying (FWM) component may be molybdenum disulfide ($MoS_2$), tungsten disulfide ($WS_2$), hexagonal boron nitride (hBN), graphite, or other materials with a lamellar structure whose superior solid lubrication properties, especially at high temperature, are well established.

The concentration of the friction modifying component in the nanolubricant may be varied as desired. For example, in one form, the concentration of the FWM component is 0.1-5% by weight to minimize the cost while providing significant wear improvement. However, the concentration may be increased as desired.

Generally, friction modifying nanoparticles have an average size of 10-100 nanometers may be used and is generally determined by the roughness of the surfaces to be contacted. The aspect ratio of the FWM nanoparticles is one for spherical and as high as 1000 for flake-like particles.

Other nanoparticles are also contemplated to be included in the nanolubricant. For example, thermal conductivity modifying nanoparticles may be included in the nanolubricant to increase the thermal conductivity relative to the base oil thermal conductivity. It should be appreciated that other suitable nanoparticles having different functionalities may also be included.

The nanolubricant may also, or in the alternative, include hybrid nanoparticles. Hybrid nanolubricants, such as those containing multiple nanoparticle components of different materials and properties, may be created to provide a single multi-component nanoparticle for use in a variety of products. Such an approach may ease the manufacturing of the nanolubricant and may improve the dispersion of materials in the resultant product.

As noted above, hybrid nanoparticles may contain two or more different nanoparticle components. In other words, two or more different types, forms, compositions, etc. of nanoparticle components may be included in a hybrid nanoparticle. The multiple components may be integrated into combined hybrid nanoparticle such that at least a portion of one of the nanoparticle components is chemically bonded to or otherwise intertwined with a second nanoparticle component. For example, one of the nanoparticle components may at least partially coat or completely coat another nanoparticle component. In another example, one of the nanoparticle components may be otherwise chemically bonded with or intertwined with another nanoparticle component.

Depending on the different types, forms, compositions, etc. of nanoparticle components used in the hybrid nanoparticle, the hybrid nanoparticle may be considered to be functionalized such that the hybrid nanoparticle may have functional features from each of the nanoparticle components. For example, the hybrid nanoparticle may be composed of a surface conditioning component and a friction or shear modifying component. Other functionalities and nanoparticle components are also contemplated, including, but not limited to, shelf-life without sedimentation, color and cost of the resultant nanolubricant.

Figure 2:
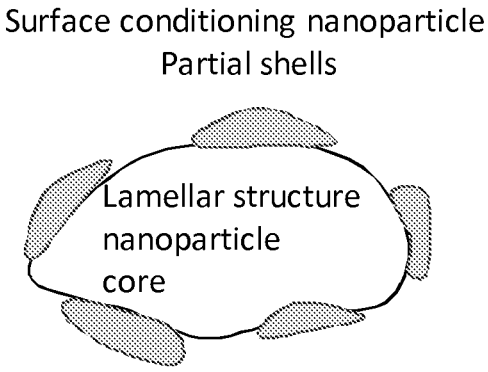
FIG. 2 is a representation of one form of a hybrid nanoparticle.

For example, as shown in FIG. 2, surface conditioning nanoparticles (SCN) are used as a partial coating (or a complete coating or shell) on other nanoparticles with low shear strength such as molybdenum disulfide, graphite, boron nitride. In this arrangement, the core can lower friction due to low shear strength while the partial shell which is made of surface conditioning nanoparticles which provide nanopolishing. Alternatively, the surface conditioning nanoparticles may form the core of the hybrid nanoparticle with the shear modifying nanoparticles forming a complete or partial shell.

The hybrid nanoparticles may be manufactured in a number of different manners. For example, the nanoparticle components may be combined in such processes including, but not limited to, mechanical ball milling, arc discharge in liquid, oxidation-reduction reactions in solution, chemical vapor deposition and the like. The methods may be modified as necessary to accommodate the different nanoparticle components and properties.

As noted above, the resulting hybrid nanoparticle may include an integration of a first nanoparticle component with a second nanoparticle component. Such integration may include intertwining, coating, partial coating and the like.

The nanolubricant may also include other components as desired. For example, in addition to the lubricant component and the hybrid nanoparticles, the nanolubricant may also include surfactants. In one form, prior to dispersion in oil, surfaces of all hybrid nanoparticles will be coated with surfactants with proper head group size and tail length depending on the overall specifications of the nanofluid. Alternatively, surfactants may be added to the nanolubricant separately from the hybrid nanoparticles. The surfactants may include, but are not limited to oleic acid, dialkyl dithiophsphate (DDP), Phosphoric acid, and Canola oil.

In one form, prior to dispersion in oil, surfaces of all hard nanoparticles will be coated with surfactants with proper head group size and tail length depending on the overall specifications of the nanofluid for dispersion stability and long shelf-life. Alternatively, the surfactant may be added to the oil prior to addition of the hard nanoparticles.

EXAMPLES

Example 1 was prepared to compare wear using an oil containing surface conditioning nanoparticles versus an oil without such nanoparticles. Each of the samples included 10W30 engine oil. Sample A included the 10W30 engine oil with nanolubricants (dispersions) consisting of 1% by weight diamond nanoparticles with an average size of 3-5 nm. A control was prepared with the 10W30 engine oil without nanolubricants.

Sample A and the control were used for conducting rolling contact fatigue (RCF) tests in a four-ball tester according with the IP-300 standard. The test conditions such as rotating speed and normal load were different from the IP-300 standard so that film thickness ratio lambda was set to be approximately 2. The tests were run for 250,000 cycles. The balls were made of AISI 52100 steel with a mean surface roughness of approximately 25 nm.

Figure 3:
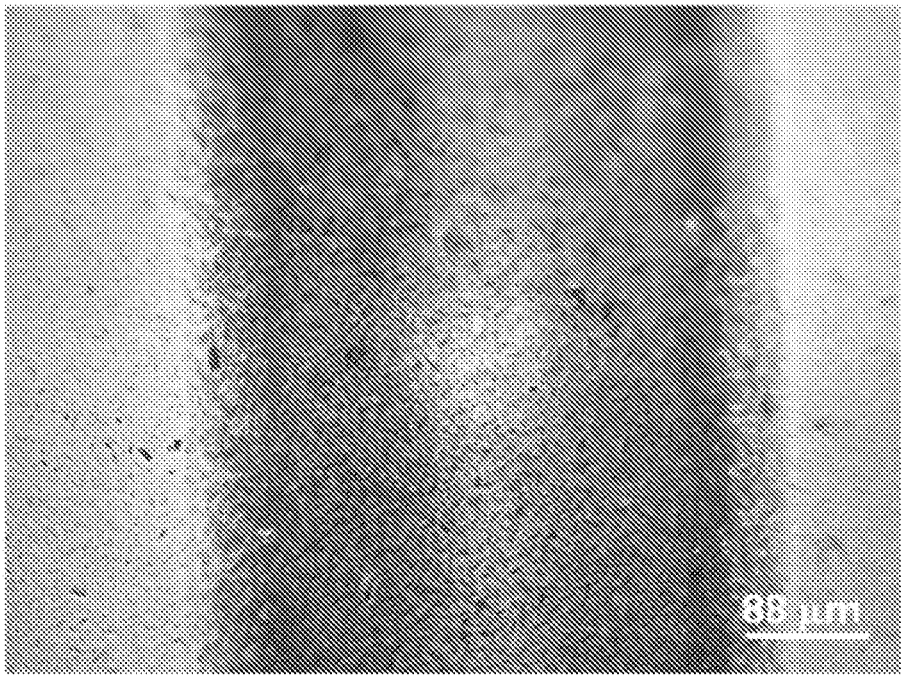
FIG. 3 is a micrograph of a surface of a contact track of a ball using an oil with a surface conditioning nanolubricant.
Figure 4:
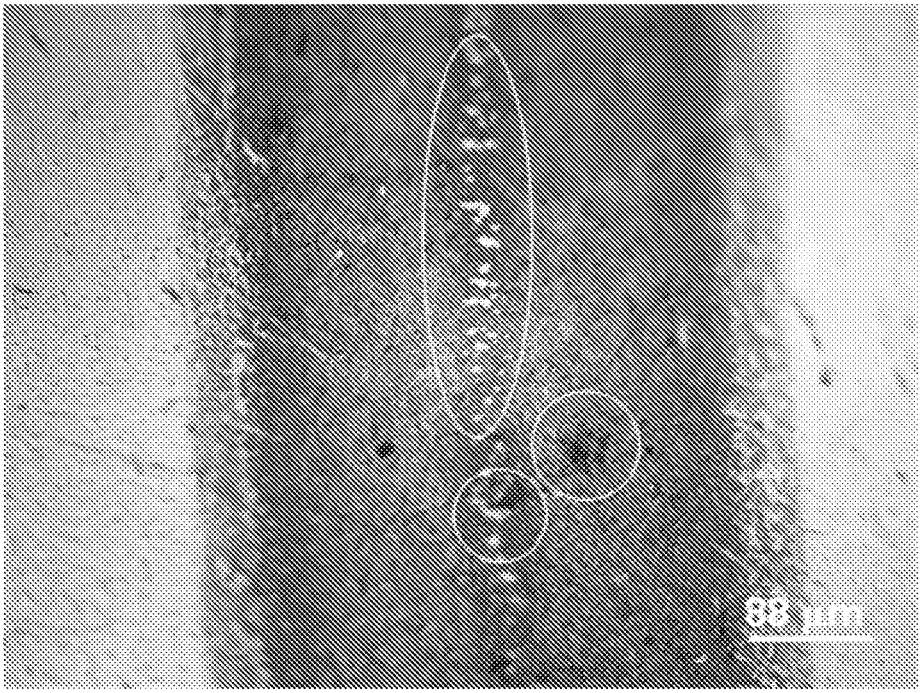
FIG. 4 a micrograph showing wear on a surface of a contact track of a ball using an oil without a surface conditioning nanolubricant.

We observed that the surface of contact track on the upper ball when using the surface-conditioning nanolubricant was smoother and with no surfaces pitting as shown in FIG. 3. The surface of upper ball when using pure 10W30 engine oil without nanolubricants exhibits pitting and rough transferred films in the encircled areas shown in FIG. 4.

Example 2 was prepared to compare contact stresses and scar diameters for other samples. In Example 2, a control was used having 10W30 engine oil which was compared to Sample B which had 10W30 engine oil as a base with 0.5% by weight diamond nanoparticles with an average particle size of 3-5 nm.

In Example 2, extreme pressure (EP) testing of the control base oil and Sample B containing surface conditioning nanolubricants was conducted according to ASTM D2873 using a four-ball tester. The ball specimens were AISI 52100 steel with a surface roughness of 25 nm.

Figure 5:
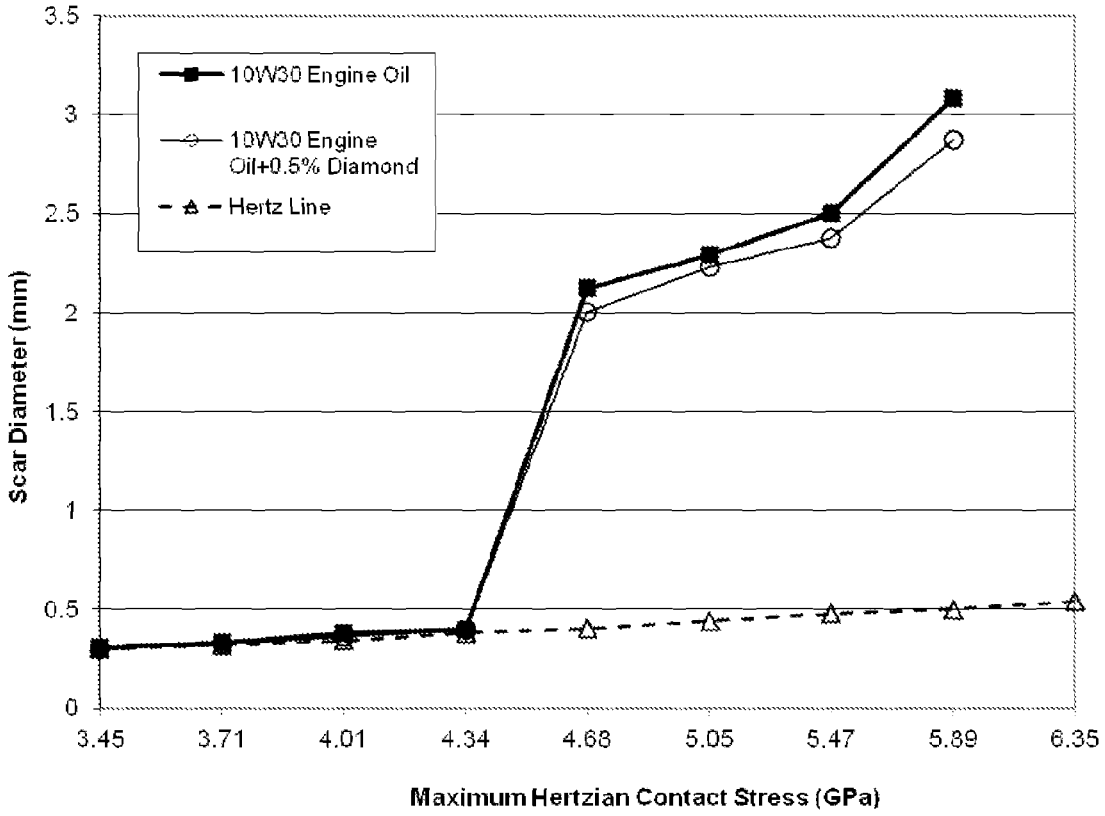
FIG. 5 is a graph illustrating the contact stress and scar diameter for samples with and without surface conditioning nanolubricants.

Sample B containing the nanolubricant yielded tribological improvements compared with the control having pure 10W30 base oil, especially at higher contact stresses. For instance, as shown in FIG. 5, the use of surface conditioning nanolubricant resulted in smaller wear scar diameters. The results are also shown below in Table 3. In the plot, the Hertz line represents the diameter of the contact area based on the ideal elastic deformation of ball without any wear.

TABLE 3

Pressure testing results

| Contact Stress | Scar Diameter (mm) | |
|---|---|---|
| Hertzian (Gpa) | Control (pure oil) | Sample B |
| 3.45 | 0.30 | 0.30 |
| 3.71 | 0.33 | 0.33 |
| 4.01 | 0.38 | 0.36 |
| 4.34 | 0.40 | 0.39 |
| 4.68 | 2.12 | 2.00 |
| 5.05 | 2.29 | 2.23 |
| 5.47 | 2.50 | 2.37 |
| 5.89 | 3.08 | 2.87 |
| 6.35 | | |

Therefore, lubricants containing nanoparticles as outlined above showed increased performance with decreased wear.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A nanolubricant composition for polishing a surface, the composition comprising:

a flowable lubricant; and a multi-component nanoparticle dispersed in the lubricant and configured to polish the surface, the multi-component nanoparticle including a first nanoparticle component which effects shearing at the surface and a second nanoparticle which effects polishing of the surface, the second nanoparticle component at least partially integrated with the first nanoparticle component, the first nanoparticle component having a lamellar structure and the second nanoparticle component selected from the group consisting of diamond, aluminum oxide, silicon oxide, boron carbide, silicon carbide and zirconium oxide.

2. The nanolubricant composition of claim 1 wherein the second nanoparticle component has a diameter that is less than one half the arithmetic average roughness or a length that is less than one half of the arithmetic average roughness.

3. The nanolubricant composition of claim 1 wherein the second nanoparticle component at least partially coats the first nanoparticle component.

4. The nanolubricant composition of claim 1 wherein the second nanoparticle component completely coats the first nanoparticle component.

5. The nanolubricant composition of claim 1 wherein the second nanoparticle component is at least partially embedded into the first nanoparticle component.

6. The nanolubricant composition of claim 1 wherein the first nanoparticle component is selected from the group consisting of molybdenum disulfide, tungsten disulfide, boron nitride and graphite.

7. The nanolubricant composition of claim 1 wherein the second nanoparticle component has a diameter of less than about 35 nm.

8. The nanolubricant composition of claim 1 wherein the second nanoparticle component has a length of less than about 35 nm.

9. A method of in-situ nanopolishing a contact surface having an arithmetic average roughness, the method comprising the steps of:

providing a nanolubricant including a flowable lubricant and multi-component nanoparticles, the multi-component nanoparticles dispersed in the lubricant and include a first nanoparticle component which effects shearing and a second nanoparticle component configured to polish the surface, the first nanoparticle component having a lamella structure and the second nanoparticle component having a hardness of at least about 7 Mohs (equivalent to 820 kg/mm$^2$ in Knoop scale) and a diameter that is less than one half the arithmetic average roughness or a length that is less than one half of the arithmetic average roughness; and polishing the contact surface using the nanolubricant to increase the ratio of a film thickness of the nanolubricant at the surface to the composite roughness.

10. The method of claim 9 wherein the second nanoparticle component at least partially coats the first nanoparticle component.

11. The method of claim 9 wherein the second nanoparticle component completely coats the first nanoparticle component.

12. The method of claim 9 wherein the second nanoparticle component is at least partially embedded into the first nanoparticle component.

13. The method of claim 9 wherein the second nanoparticle component is selected from the group consisting of diamond, aluminum oxide, silicon oxide, boron carbide, silicon carbide and zirconium oxide.

14. The method of claim 9 wherein the first nanoparticle component is selected from the group consisting of molybdenum disulfide, tungsten disulfide, boron nitride and graphite.

15. The method of claim 9 wherein the second nanoparticle component has a diameter of less than about 35 nm.

16. The method of claim 9 wherein the second nanoparticle component has a length of less than about 35 nm.

17. The method of claim 9 wherein the second nanoparticle component has a diameter that is less than one half the arithmetic average roughness or a length that is less than one half of the arithmetic average roughness.

* * * * *